US005441447A

United States Patent [19]

Okada

[11] Patent Number: 5,441,447

[45] Date of Patent: Aug. 15, 1995

[54] COIN DISPENSER AND COIN PAY-OUT METHOD

[75] Inventor: Kazuo Okada, Tokyo, Japan

[73] Assignee: Kabushiki Kaisha Universal, Tochigi, Japan

[21] Appl. No.: 79,520

[22] Filed: Jun. 21, 1993

[30] Foreign Application Priority Data

Jun. 19, 1992 [JP] Japan ..... 4-161211

[51] Int. Cl.[6] ..... G07D 9/04

[52] U.S. Cl. ..... 453/32; 377/7

[58] Field of Search ..... 453/32; 194/200, 201, 194/202; 273/138 A; 379/145, 146; 232/57.5, 58; 377/7

[56] References Cited

U.S. PATENT DOCUMENTS

| | | | |
|---|---|---|---|
| 4,429,407 | 1/1984 | Furuya | 377/7 |
| 4,753,625 | 6/1988 | Okada | 453/32 |
| 5,146,492 | 9/1992 | Stone et al. | 194/202 X |

FOREIGN PATENT DOCUMENTS

| | | | |
|---|---|---|---|
| 0122138 | 10/1984 | European Pat. Off. . | |
| 0266021 | 5/1988 | European Pat. Off. . | |
| 0312316 | 4/1989 | European Pat. Off. . | |
| 3128235 | 2/1983 | Germany . | |
| 2124006 | 2/1984 | United Kingdom | 453/32 |

*Primary Examiner*—F. J. Bartuska
*Attorney, Agent, or Firm*—Young & Thompson

[57] ABSTRACT

A slot machine incorporates a coin dispenser, which has a discharge section that discharges a coin toward a discharge slot. A sensor is arranged at the discharge slot, and generates a detection signal upon detecting a coin. A counter counts the detection signal, to generate a count signal. A pay-out controller drives the discharge section in accordance with a pay-out signal, and prevents the discharge section from operating to complete the pay-out, when the count value equals a predetermined number of coins to be paid out. If the detecting signal is received before receiving the pay-out signal, the pay-out controller prevents the discharge section from operating, to protect the slot machine from a player's fraud. If the detection signal is received before receiving the pay-out signal or after completing the pay-out, the pay-out controller signals an error. A blocking plate is arranged to close the discharge slot. When pushed by the passing coin, the plate is opened to allow the coin to pass. Thereafter, the plate swings shut by gravity to prevent fraudulent operation of the machine by insertion of an implement backward through the slot.

15 Claims, 7 Drawing Sheets

COIN DISPENSER AND COIN PAY-OUT METHOD

BACKGROUND OF THE INVENTION

1. Field of the Invention

The present invention relates to a coin dispenser and a method of paying out coins. More particularly, the present invention relates to a coin dispenser applied to a coin-operated machine such as a gaming machine, and relates also to a coin pay-out method in which fraud can be detected in the operation of the coin-operated machine.

2. The Prior Art

A coin-operated machine is operated in response to the insertion of coins, tokens, medals or other disks (herein referred to as coins) into an inlet slot. Such coin-operated machines include slot machines, other gaming machines, vending machines and money-changing machines. A slot machine for example, incorporates a coin dispenser, which discharges coins, as stored in the slot machine, into a coin trough. At a discharge port of the coin dispenser, there is arranged a coin pay-out sensor, which is adapted to detect coins that pass through the discharge port, so as to send a detection signal to a pay-out counter. The counter counts these detection signals, and when the counted value becomes equal to the predetermined number of dividend coins, the discharge motor is stopped from rotating, which terminates the discharge of coins.

However, conventional coin dispensers are vulnerable to fraud committed by a fraudulent player on the pay-out sensor. To perpetrate such a fraud, a long flexible tool is inserted into the pay-out sensor through the trough in advance of a pay-out instruction. The sensor is thus kept insensitive to the coins, keeping the pay-out counter from stepping. In this way, when the pay-out counter counts no steps or counts steps fewer in number than the coins legitimately to be paid out, the player will receive extra coins not detected by the pay-out sensor, thus more coins than the dividend as actually won.

OBJECT OF THE INVENTION

In view of the foregoing problems, an object of the present invention is to provide a coin dispenser and a coin pay-out method, by the use of which a coin-operated machine can be protected from fraud with the provision of a simple structure.

SUMMARY OF THE INVENTION

In order to achieve the above and other objects and advantages, a discharging section discharges the coin toward the discharging port. A sensor is arranged at the discharging port for generating a detection signal upon detecting the coin. Counting means counts the detecting signal so as to generate a count signal. Control means drives the discharging section in accordance with the pay-out instruction, and stops the discharging section from actuation to complete the pay-out when the counted value of the count signal reaches a predetermined number of coins to be paid out. The control means monitors the sensor and, if the detection signal is received before receiving the pay-out instruction, keeps the discharging section from acting. Thereby, a coin-operated machine can be protected from fraud with the provision of a simple structure.

In a preferred embodiment, if the detection signal is received before receiving the pay-out instruction or after completing the pay-out, the control means signals an error. Moreover, a blocking plate is arranged to be shiftable between respective positions of closing and opening the discharge port, and to be pushed by the coin as passed through the discharge port, thereby to be displaced from the closed position into the open position so as to allow the coin to pass.

Known coin dispensers have a jam-eliminating construction in which, if it detects an unchanged level in the detection signal over a predetermined period, the disk is rotated reversely by a certain amount and subsequently rotated normally. This is for the purpose of eliminating a jamming of coins in the coin dispenser. Such a jam being eliminated, the discharge motor is prevented from being loaded excessively, and is thus protected from damage. But a coin dispenser with this jam-eliminating construction would be still vulnerable to fraud committed by a fraudulent player acting on the pay-out sensor with a long tool. In such a fraud, the tool would first be inserted into the pay-out sensor in advance of receiving an instruction for pay-out. The sensor would be kept insensitive coin by coin, keeping the pay-out counter from stepping. Then the external tool would be withdrawn during the reverse rotation of the motor, before the motor would again rotate normally. As illustrated in FIG. 7, four coins are discharged while counting only one in the first normal rotation, and five coins are discharged while counting five in the second normal rotation. Thus the player would fraudulently obtain nine coins during the six steps counted, by use of the external tool.

The novel coin dispenser in combination with a jam-eliminating construction, however, can protect a coin-operated machine from fraud with the provision of a simple structure.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
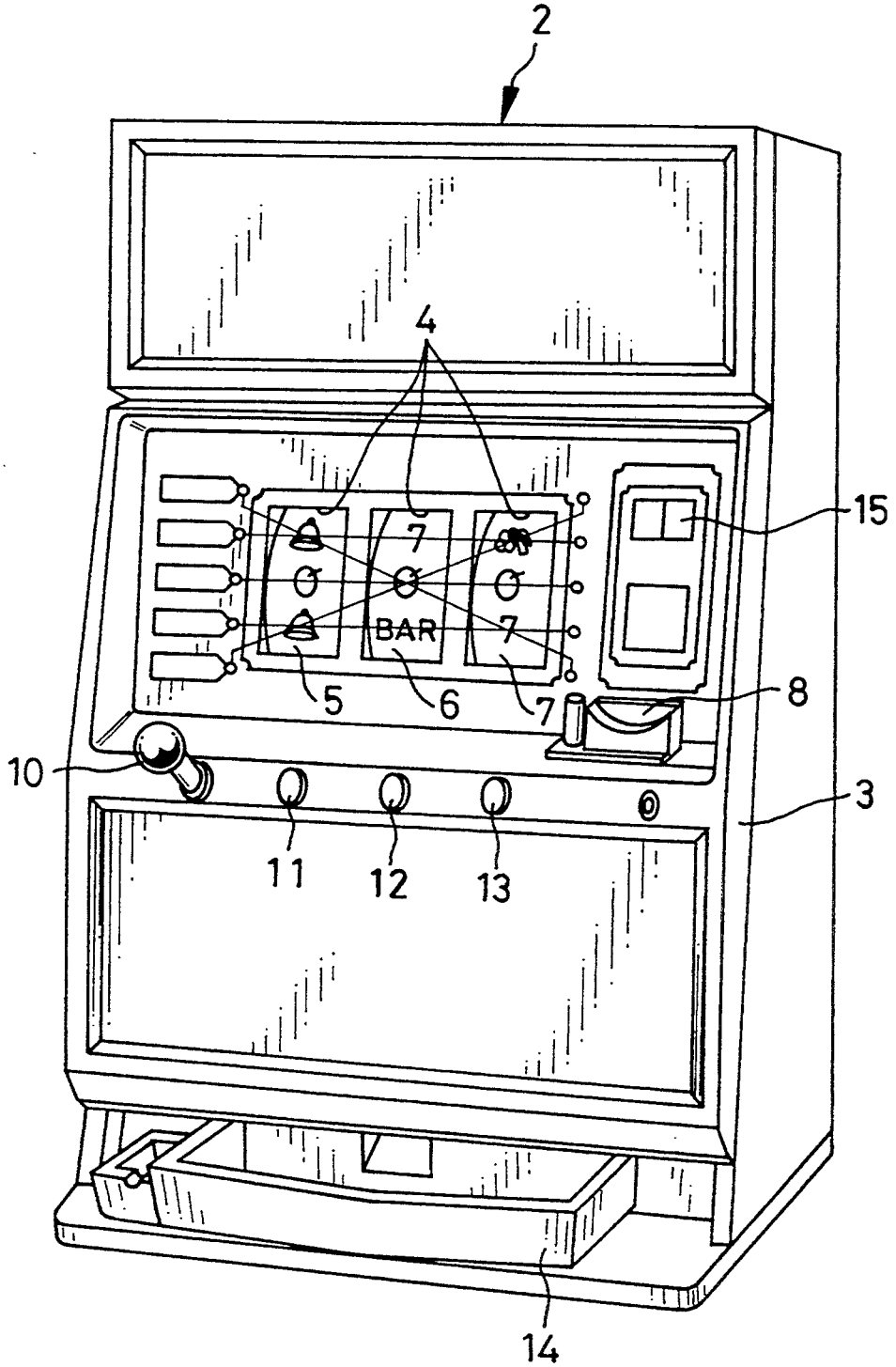
FIG. 1 is a perspective view illustrating a slot machine incorporating a novel coin dispenser according to the invention.

In FIG. 1 illustrating a slot machine incorporating a novel coin dispenser, a front door 3 is openably mounted on a main body 2 of the slot machine. In the front door 3 are formed windows 4 for external observation of symbols on reels incorporated in respective reel units 5, 6 and 7. Under the windows 4, there are arranged an inlet slot 8 through which coins C are inserted, a starting lever 10 for rotating the reel units 5 to 7 simultaneously, and stop buttons 11 and 13 for stopping the reel units 5 to 7, respectively.

To begin a game, a player inserts one, two or three coins C into the inlet slot 8. Winning lines for effective alignment of symbols are selected among horizontal or slant lines across the three reel units 5 to 7. The more coins C are inserted, the more winning lines are selected. Operation of the starting lever 10 causes rotation of the reel units 5 to 7; the stop buttons 11 to 13 are thereafter actuated to stop the reel units 5 to 7, respectively. Upon stopping in the positions displaying a winning combination and upon determination of a win, coins C are paid out into a trough 14. An indicator 15 displays the number of coins C paid out.

Figure 2:
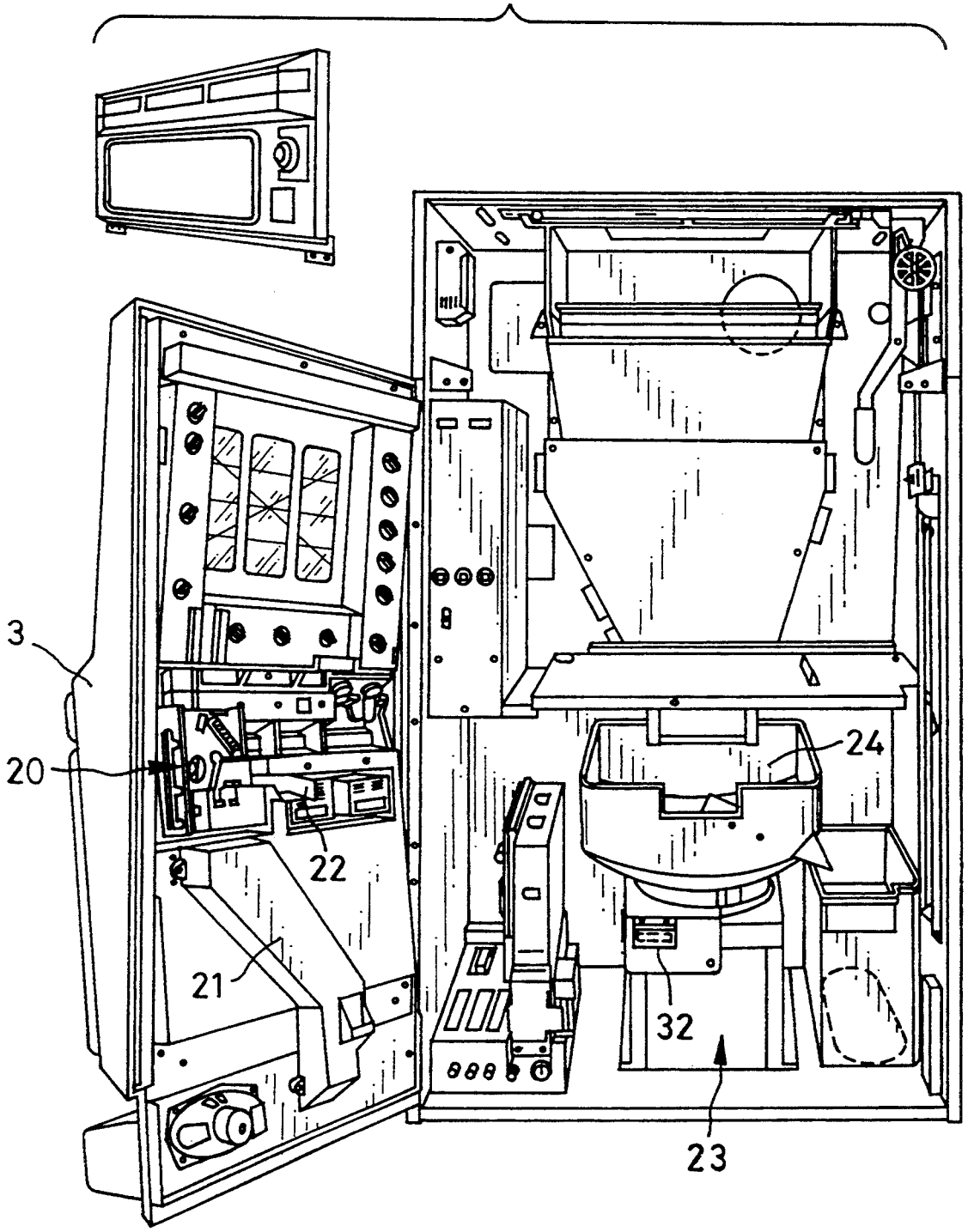
FIG. 2 is a perspective view illustrating the slot machine open to show the coin dispenser.
Figure 5:
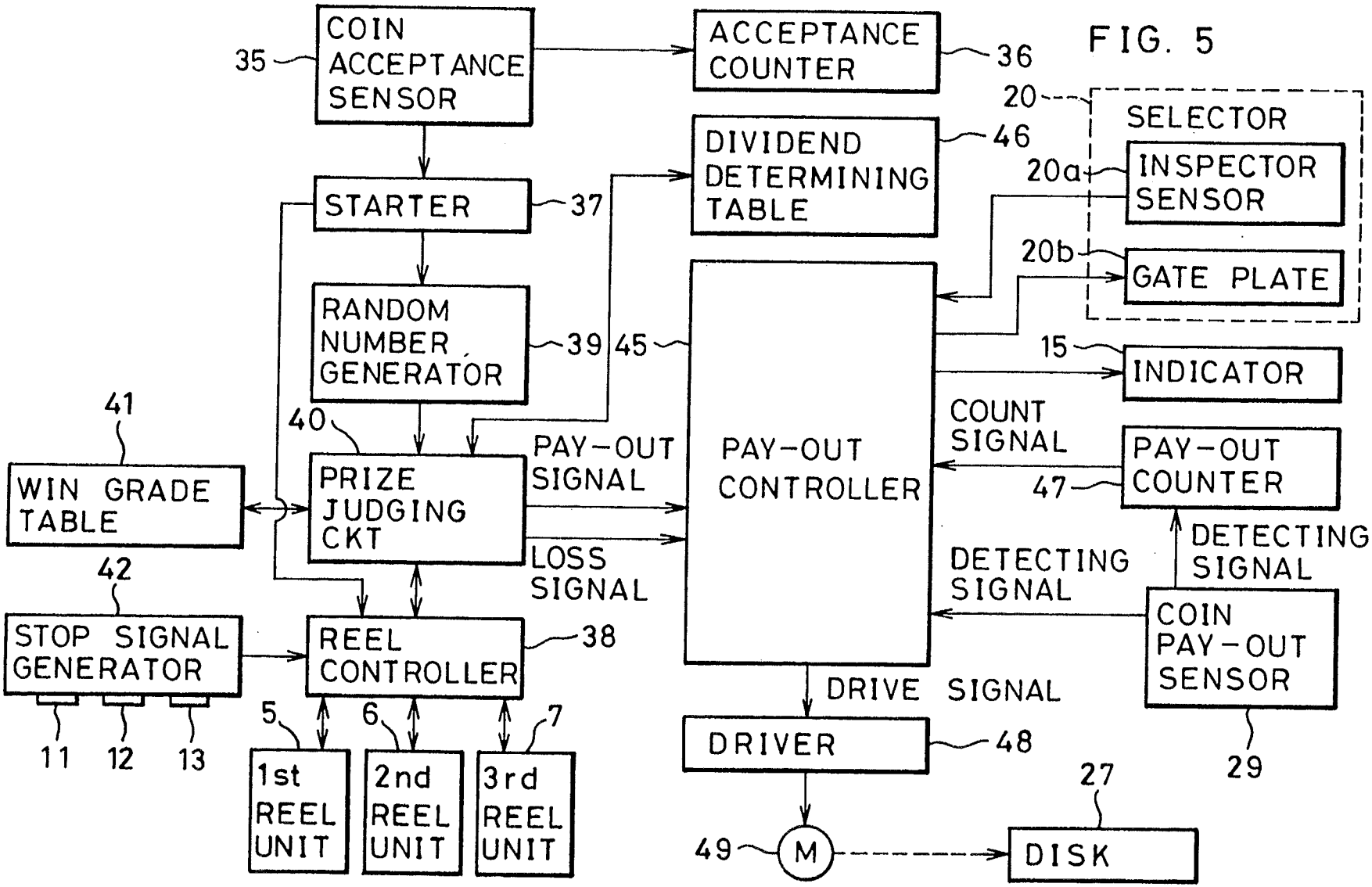
FIG. 5 is a block diagram illustrating the electrical arrangement of the slot machine with the coin dispenser.

In FIG. 2, it will be seen that the inside of the front door 3 is provided with a coin selector 20 having, as seen in FIG. 5, an inspection sensor **20*a* for judging acceptability of the coin C inserted, and a gate plate 20*b*. When the coin C is detected to be unacceptable, namely, different from a predetermined denomination, the gate plate 20*b* opens a return chute 21 to pass the coin C to the trough 14. When the coin C is detected to be acceptable, namely, of the predetermined denomination, the gate plate 20*b* opens an accepting chute 22 to pass the coin C to a storage bucket 24 of the novel coin dispenser 23 in the center of the slot machine. In the accepting chute 22 is arranged a coin acceptance sensor 35, which is connected to an acceptance counter 36 for counting only the acceptable coins inserted, later to be described in detail. Note that the reel units 5 to 7, including each reel, stepping motor, and sensor for monitoring the rotated position of the reel, are omitted from FIG. 2**, but are actually mounted in the slot machine.

Figure 3:
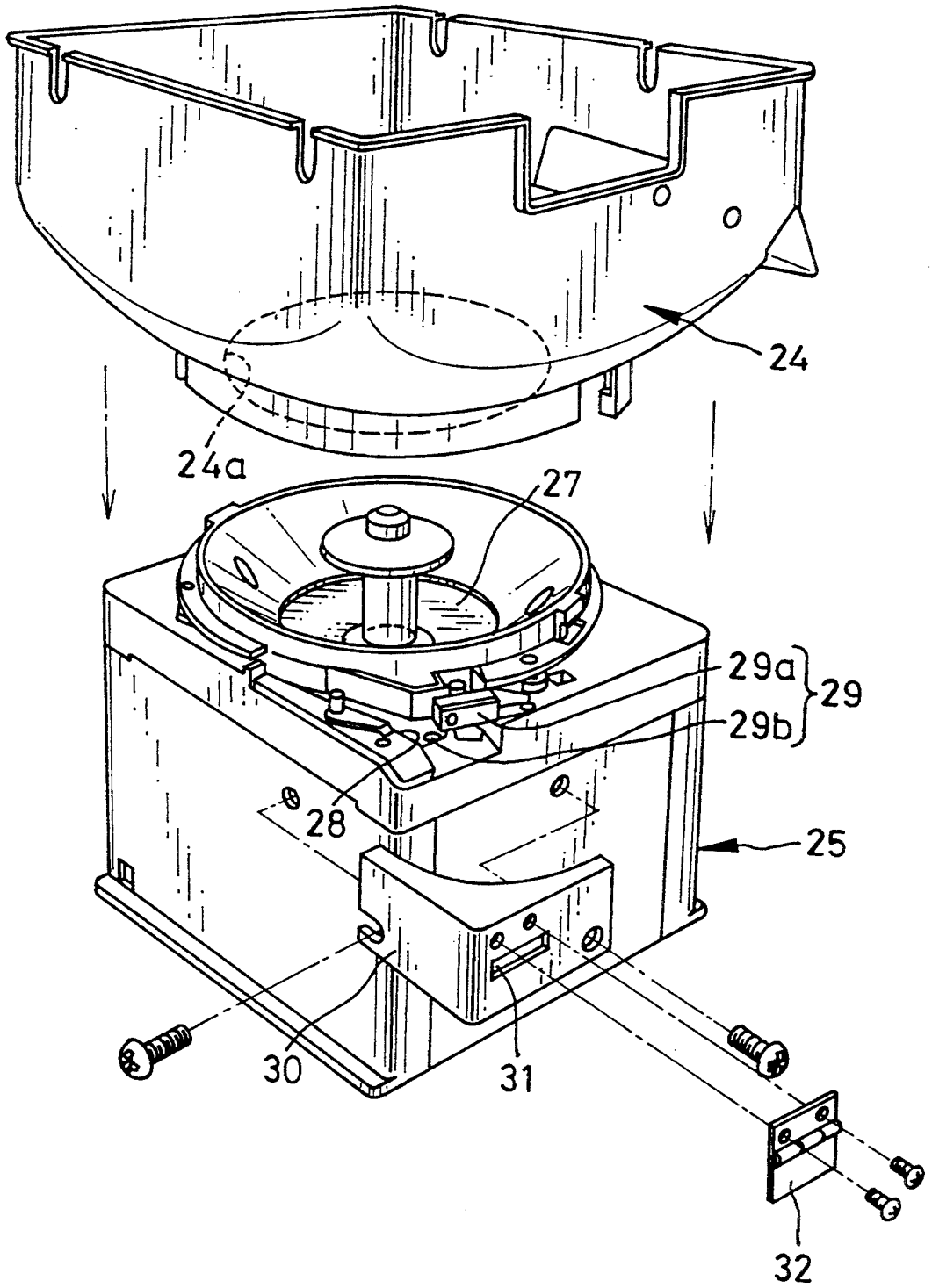
FIG. 3 is an exploded perspective view illustrating the coin dispenser.

FIG. 3 illustrates the coin dispenser 23, which is generally constituted of an electrically driven discharge section 25 and the storage bucket 24. The discharge section 25 has, as seen in FIG. 5, a motor 49 actuated by a pay-out controller 45 and a rotary disk 27 rotated by the motor 49. When the disk 27 is rotated counterclockwise, the coins brought through a passage opening 24a in the storage bucket 24 are subjected to centrifugal force on the disk 27, are moved into an exit slot and are guided through a communicating guide passageway 28 formed in a discharge section 25.

In the guide passageway 28 is arranged a coin pay-out sensor 29 of a photoelectric type, constituted by a light projector **29*a* and a light receiver 29*b*. When a beam from the projector 29*a* is blocked by a coin C, the receiver 29*b* generates a detection signal of High level, and sends it to the pay-out controller 45 and a pay-out counter 47**, later to be described.

Figure 4:
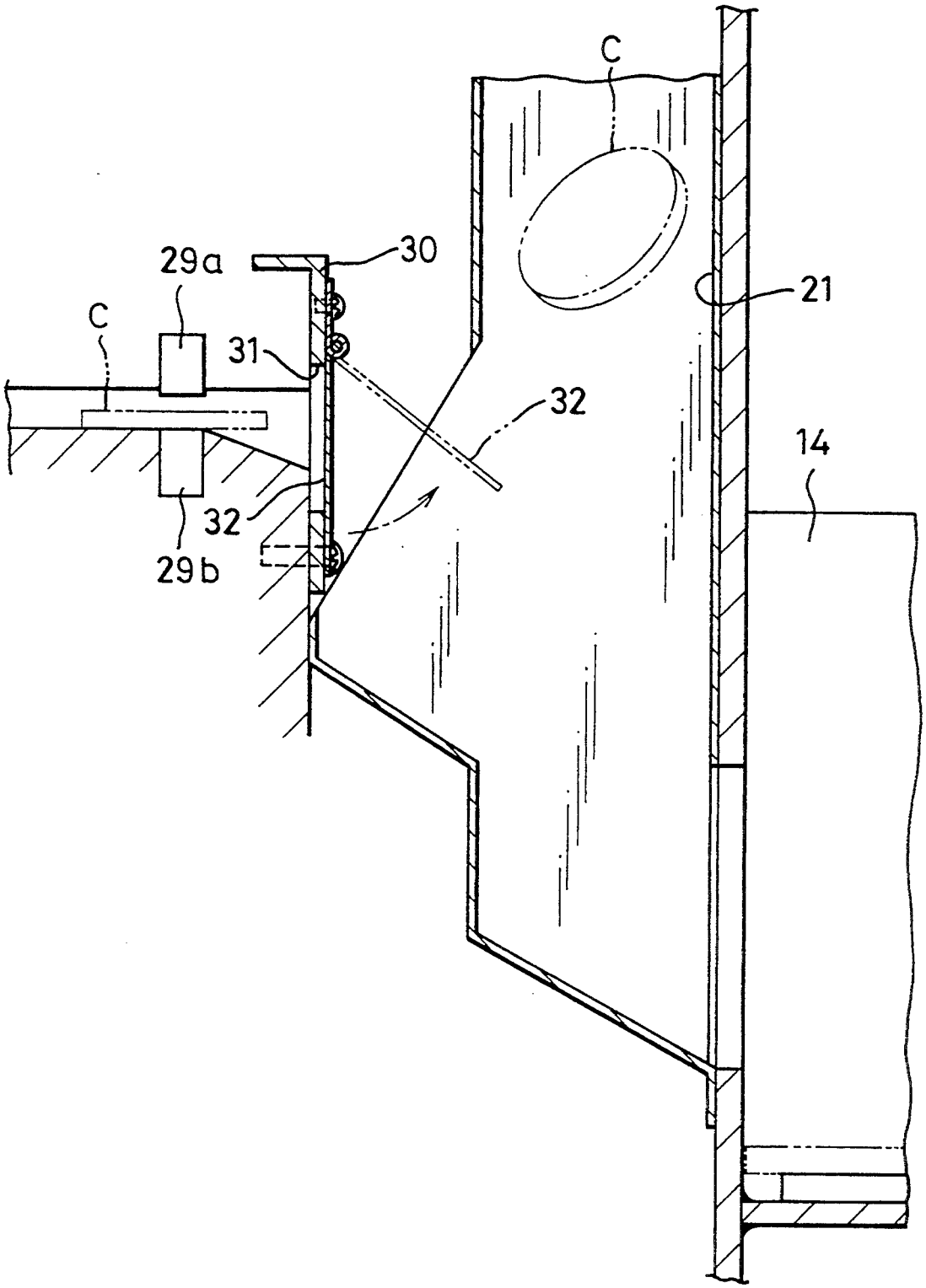
FIG. 4 is a cross section illustrating a discharge slot of the coin dispenser, with associated structures.

A cover 30 is fixed over the passageway 28 to cover the pay-out sensor 29 and is held on by screws. The cover 30 is provided with a discharge slot 31 and a hinged plate 32 openably closing the slot 31. As illustrated in FIG. 4, the weight of the plate 32 causes it to close the slot 31, as indicated by the full line, so as to prevent players from inserting a long tool through the trough 14 into the slot 31, i.e. to prevent dishonest players from committing fraud by operating the pay-out sensor 29 externally. When the coin C moves through the passageway 28, the coin C pushes the plate 32 open and swings it into the position indicated by phantom lines so as to open the slot 31 entirely. The coin C passes through the slot 31 and falls into the return chute 21 and is discharged into the trough 14.

In FIG. 5 illustrating the electrical arrangement, the coin acceptance sensor 35 detects acceptable coins C inserted into the inlet slot 8. The coins C detected to be acceptable are counted by the acceptance counter 36 so as to determine the number of winning lines of symbols that will be in play. The acceptance sensor 35, upon sensing at least one acceptable coin C, generates a start-enabling signal and sends it to a starter 37, which, in response to actuation of the starting lever 10, generates a starting signal.

The starting signal is sent to a reel controller 38 and a random number generator 39. In response to the starting signal, the reel controller 38 drives stepping motors respectively incorporated in the reel units 5 to 7. The random number generator 39, in response to the starting signal, samples one random number from a train of random numbers within a predetermined range, and enters the sampled number into a prize judging circuit 40.

According to the sampled number from the random number generator 39, the prize judging circuit 40 determines a win or loss of the game played. To the prize judging circuit 40 is connected a win grade table 41, which stores information on all the retrievable random numbers respectively associated with a big win, a medium win, a small win or a loss (no win). The prize judging circuit 40 refers to the win grade table 41, and determines one of the four win categories associated with the sampled number. A stop-designating table stored in the prize judging circuit 40 is referred to, so that, according to the one win category as address data, a combination of stop-designated positions is sent to the reel controller 38.

When the stop buttons 11 to 13 are operated, a stop signal generator 42 sends a stop signal to the reel controller 38, to control the stopping of the reel units 5 to 7. By controlling the reel units 5 to 7, the symbols appear along a respective effective winning line in such a manner as to form a particular symbol combination associated with the win category selected by the prize judging circuit 40. When the reels are completely stopped, the reel units 5 to 7 send back information on their stopped positions to the reel controller 38. The prize judging circuit 40 receives the position information from the reel controller 38 and confirms to which win category the stopped position corresponds. To do this, a winning combination table stored in the prize judging circuit 40 is referred to, so that, using the combination of stopped positions as address data, a prize-winning combination is obtained or not. The prize judging circuit 40 refers to a dividend determining table 46 storing the association of each win category with a dividend to be paid or not, and then sends to a pay-out controller 45 a loss signal or a pay-out signal representing the number of coins to be paid and constituting the pay-out instruction.

When a loss or pay-out signal is generated, the pay-out controller 45 initially monitors the pay-out sensor 29 to find the existence of a detection signal. If the pay-out sensor 29 has generated a detection signal, then the pay-out controller 45 drives the coin selector 20, to open the return chute 21, to cause the inlet slot 8 to communicate directly with the trough 14, so that inserted coins C will simply fall through without triggering a play. The controller 45 also drives the indicator 15 to display an error. If the pay-out sensor 29 has not generated any detection signal despite the existence of a pay-out signal, then the pay-out controller 45 sends a drive signal to a driver 48. If a loss signal is received without generation of any detection signal from the pay-out sensor 29, the game is terminated without paying out any coins C.

When a drive signal is sent in the driver 48, the motor 49 is rotated normally, namely, in the forward direction, to rotate the disk 27. The rotation of the disk 27 sends coins C from the storage bucket 24, through the passageway 28 toward the discharge slot 31. When a coin C passes through the pay-out sensor 29, a detection signal is sent to the pay-out counter 47 and the pay-out controller 45. The pay-out counter 47 incrementally counts one step upon extinction of the detection signal. When the counted value equals the number of coins to be paid, the pay-out controller 45 stops the motor 49 from rotating.

It can happen that the generation of detecting signals is abnormal, which will imply a jamming of the coins in or under the storage bucket 24 on the surface of the disk 27: the coins are overlapped on each other in a manner to give rise to a gap or hollow between or under the coins. In response to a continued High level or Low level of the detection signal, for a predetermined period of time, a sequence for eliminating the jamming of coins is performed, by stopping the motor 49, rotating it reversely, stopping it again, and successively rotating it normally. For example, this jam-eliminating sequence can be performed when no detection signal is generated for three seconds even after starting the motor 49, when on detection signal is generated after the latest detection signal, and when one detection signal has a duration at High level for four seconds.

Figure 6:
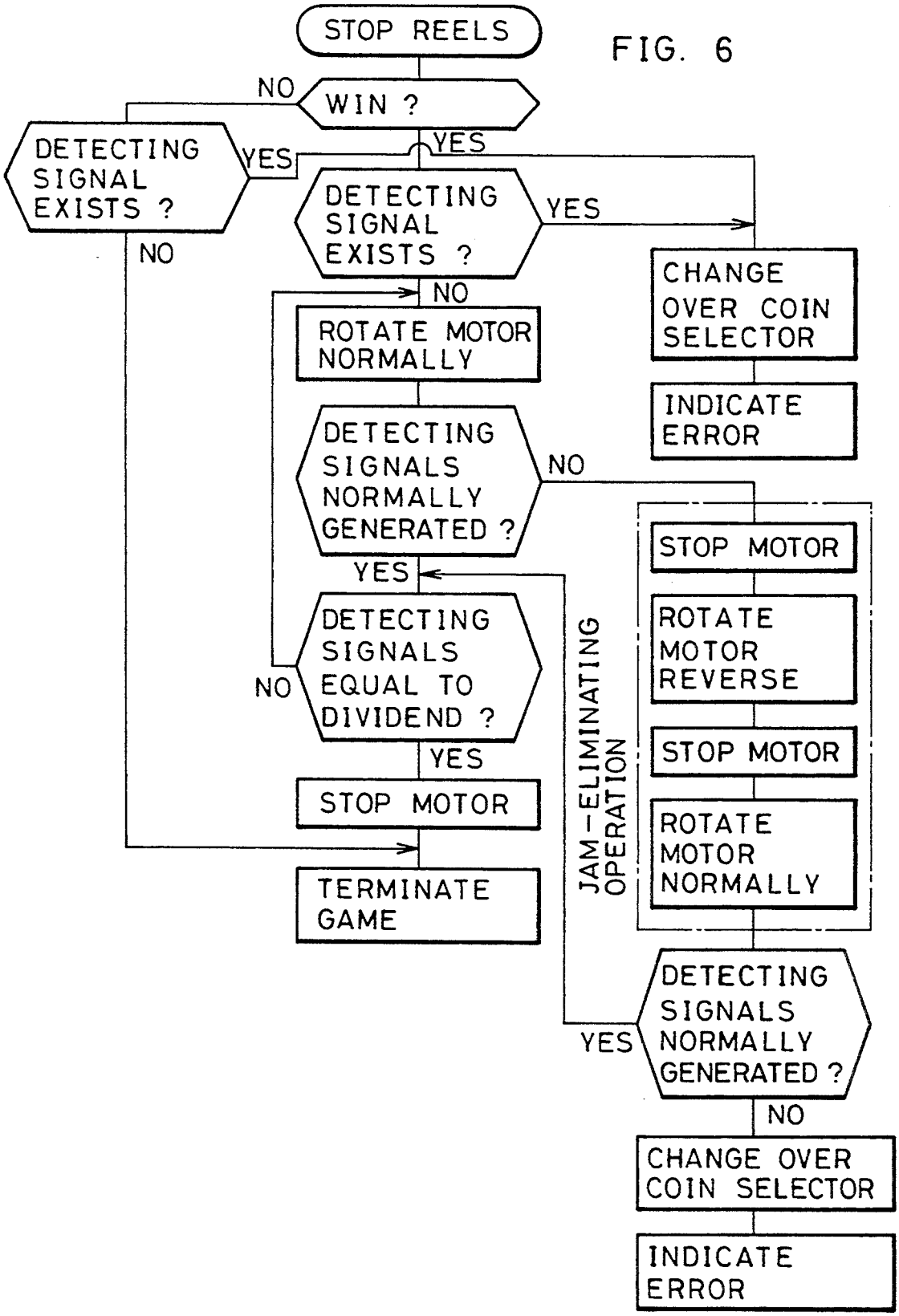
FIG. 6 is a flow chart illustrating a coin pay-out method according to the novel coin dispenser.
Figure 7:
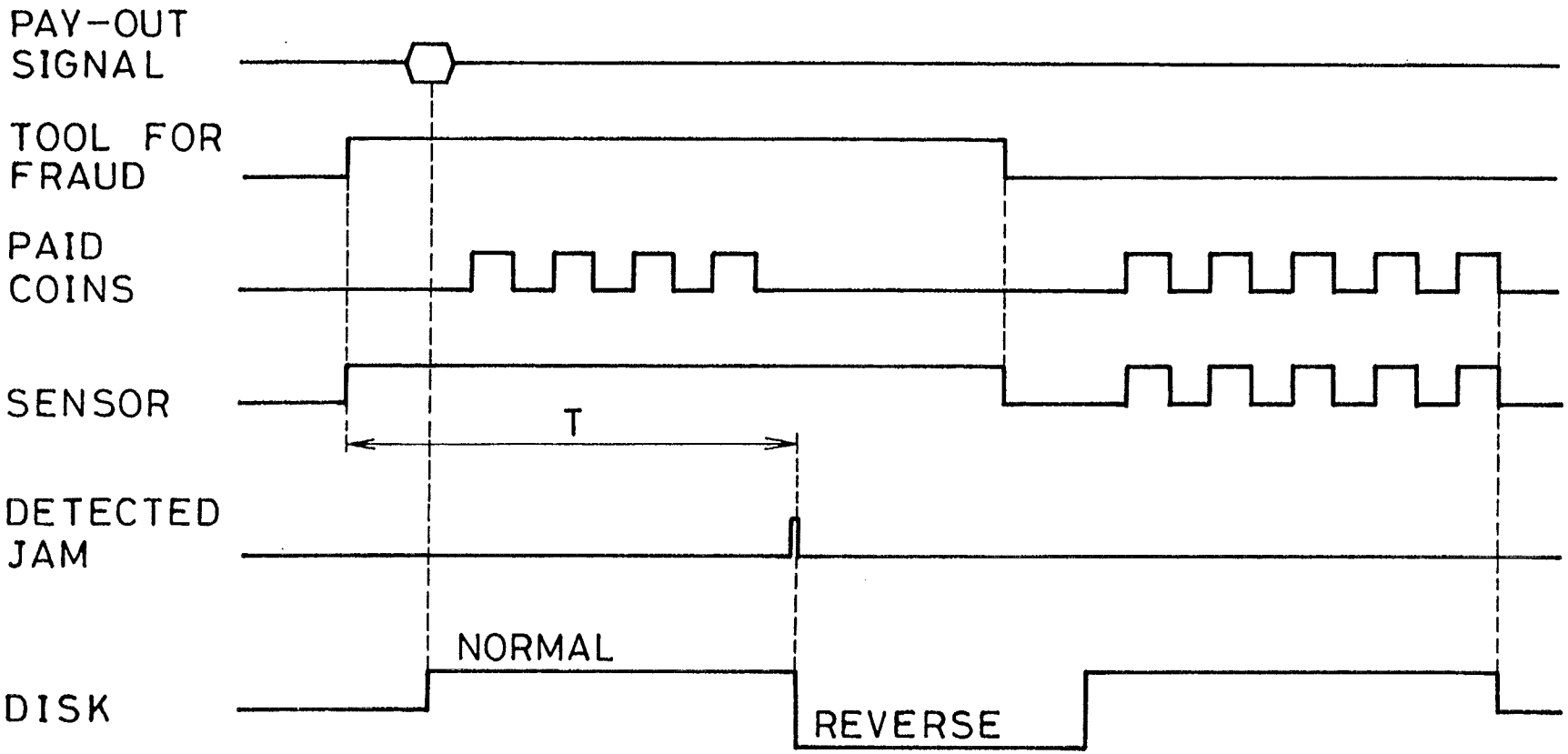
FIG. 7 (PRIOR ART)
FIG. 7 is a timing chart illustrating how a prior art coin dispenser suffers from fraud by the insertion of a tool.

Referring to FIG. 6, operation of the above-constructed coin dispenser will now be described. With a coin C inserted through the inlet slot 8, the starting lever 10 is swung down, to initiate rotation of the reel units 5 to 7. The stop buttons 11 to 13 are pressed to stop the reel units 5 to 7. When it is confirmed that a symbol combination along a winning line is a winning combination, then the prize judging circuit 40 sends a pay-out signal to the pay-out controller 45.

When the pay-out signal is sent to the pay-out controller 45, the pay-out controller 45 detects the existence of a detection signal. If there has been generated a detection signal, then the pay-out controller 45 drives the coin selector 20, opens the return chute 21, causes the inlet slot 8 to communicate directly with the trough 14, and so avoids playing by the insertion of further coins C. The indicator 15 is caused to display an error. Thus the novel construction avoids fraud by the insertion of a flexible long tool through the trough 14, which would keep the pay-out sensor 29 from detecting coins and cause the coin dispenser 23 to pay more coins than the proper number. Note that, although the error detected is indicated on the indicator 15, it can be signaled both visually and acoustically, e.g. by use of a loudspeaker or a buzzer.

When no detection signal has been generated by the pay-out sensor 29, the pay-out controller 45 receives a pay-out signal associated with a dividend, to cause the driver 48 to rotate the motor 49 normally. The coin C is guided through the passageway 28 into the slot 31, pushes open the blocking plate 32, and falls through the return chute 21 to the trough 14. As the blocking plate 32 prevents the insertion of external tools, it prevents fraudulent manipulation causing the pay-out sensor 29 to malfunction, which would cause the coin dispenser 23 to pay more coins than the proper number. As each coin C passes through the pay-out sensor 29, one new detection signal is generated. When the sum of the detection signals equals the number of dividend coins, then the pay-out controller 45 stops the motor 49 from rotating. Pay-out is completed, and the game is terminated.

When the pay-out controller 45 detects that the detection signal has remained unchanged between the High and Low levels for several seconds during normal rotation of the motor 49, it is perceived that there is a jamming of coins. The motor 49 is stopped, and then rotated reversely for a predetermined period. This is effective for eliminating such a jamming of coins wherein the coins are overlapped one on another in a manner to give rise to a gap or hollow between or under the coins.

The motor 49 is rotated in the normal direction again. The coins are discharged through the discharge slot 31. The pay-out controller 45 again receives extinction of the detection signals within the predetermined period. The pay-out counter 47 counts the coins paid out, until the controller 45 judges that the counted value equal the dividend. The controller 45 completes pay-out by stopping the motor 49.

Although the motor 49 rotates again normally, it is possible that the pay-out controller 45 may detect a detection signal unchanged between High and Low levels for several seconds for a second time. If it does, then the motor 49 in the coin dispenser 23 is stopped. The pay-out controller 45 drives the coin selector 20, opens the return chute 21, causes the inlet slot 8 to communicate directly with the trough 14, and thus avoids playing by the insertion of coins C. The indicator 15 is caused to display an error.

If a game is lost as judged by the prize judging circuit 40 upon the reel units 5 to 7 being operated and stopped, then a loss signal is generated to terminate the game. If a detection signal is generated before the generation of a loss signal, the controller 45 drives the coin selector 20 to cause the inlet slot 8 to communicate directly with the trough 14, to prevent coin acceptance. The indicator displays an error, which error is acoustically signaled as well.

In the above embodiment, the pay-out counter 47 is of the general type that counts step by step. Alternatively, a preset counter may be used, which can store a predetermined number of coins, e.g. ten, and may be adapted to generate a signal of termination upon counting the predetermined number. To use this, a signal of the predetermined number may be sent to the preset counter from the pay-out controller 45 according to a pay-out signal associated with one particular dividend to be paid according to the combination of stopped positions.

In the above embodiment, the existence of a detection signal is monitored after generation of a pay-out or loss signal. Alternatively, the existence of a detection signal may be monitored after stopping of the reels before the generation of a pay-out or loss signal. The existence of a detecting signal may also be monitored periodically.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

What is claimed is:

1. A coin dispenser for paying out coins through a discharge port upon receipt of a pay-out instruction, comprising:

a discharge section for discharging said coins toward said discharge port;

a sensor arranged at said discharge port for generating a detection signal upon detecting a said coin;

counting means for counting said detection signals so as to generate a count signal; and control means for driving said discharge section in accordance with said pay-out instruction, and for stopping said discharge section from actuation to complete said pay-out when the count value of said coin signal equals a predetermined number of coins to be paid out, said control means detecting a condition wherein a detection signal is present prior to driving said discharge section, and preventing said discharge section from commencing operation upon detection of said condition.

2. A coin dispenser as defined in claim 1, wherein the existence of said detection signal is checked upon receiving said pay-out instruction.

3. A coin dispenser as defined in claim 1, wherein, if said detecting signal is received before receiving said pay-out instruction or after completing said pay-out, said control means further signals an error.

4. A coin dispenser as defined in claim 3, wherein said error signal is visible or audible.

5. A coin dispenser as defined in claim 4, further comprising an external indicator for signaling said error.

6. A coin dispenser as defined in claim 4, which is incorporated in a coin-operated machine;

which further comprises a storage section arranged upstream from said discharge section for storing a plurality of coins, and a selector for discharging said coin, after insertion into said coin-operated machine, as soon as said control means has signaled said error.

7. A coin dispenser as defined in claim 6, wherein said selector further inspects said coin inserted into said coin-operated machine in order to guide said coin into said storage section when said coin is acceptable, and to discharge said coin when said coin is unacceptable.

8. A coin dispenser as defined in claim 7, wherein:

a passage opening is formed in a bottom of said storage section;

said discharge section includes:

a disk for receiving a coin supplied from said storage section through said passage opening, and for rotating said coin thereon to slide said coin outward under centrifugal force; and a guide passageway open to a circumference of said disk for guiding said coin, as slid under centrifugal force, toward said discharge port.

9. A coin dispenser as defined in claim 8, wherein, if said control means detects an unchanged level in said detection signal over a predetermined period of time, said disk is rotated reversely and subsequently rotated normally.

10. A coin dispenser as defined in claim 9, wherein, if said control means detects an unchanged level in said detection signal over a predetermined period of time after said reverse and normal rotation of said disk, said control means signals an error.

11. A coin dispenser as defined in claim 1, further comprising a blocking plate shiftable between positions closing and opening said discharge port, and adapted to be pushed open by said coin passing through said discharge port, thereby to allow said coin to pass, said blocking plate thereafter closing to prevent the insertion of objects into said discharge port in a direction opposite the direction of movement of said coin through said discharge port.

12. A coin dispenser as defined in claim 11, wherein said blocking plate is arranged outside said discharge port, and cannot be pushed from said closed position toward said open position from outside said discharge port.

13. A coin dispenser as defined in claim 12, wherein said blocking plate is hinged rotatably, and moves toward said closed position under gravity.

14. A method of paying a coin out of a coin dispenser in which said coin is discharged through a discharge port by driving a discharge section upon receiving a pay-out instruction, comprising:

generating a detection signal upon detecting said coin at said discharge port;

counting said detection signal;

stopping said discharge section from operating to complete said pay-out when the counted detection signals equal a predetermined number of coins to be paid out; and preventing said discharging section from commencing operation if said detection signal is received before said discharge section has been driven.

15. A coin pay-out method as defined in claim 14, further comprising the steps of:

signaling an error if said detection signal is received before receiving said pay-out instruction; and signaling an error if said detection signal is received after completing said pay-out.

* * * * *